US011603274B2

(12) United States Patent
Lin

(10) Patent No.: US 11,603,274 B2
(45) Date of Patent: Mar. 14, 2023

(54) PAPER FEEDING MECHANISM

(71) Applicant: Foxlink Image Technology Co., Ltd., New Taipei (TW)

(72) Inventor: Ming Wei Lin, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 17/567,155

(22) Filed: Jan. 3, 2022

(65) Prior Publication Data

US 2022/0340381 A1 Oct. 27, 2022

(30) Foreign Application Priority Data

Apr. 22, 2021 (CN) ..... 202120843868.3

(51) Int. Cl.
*B65H 9/00* (2006.01)
*B65H 3/06* (2006.01)

(52) U.S. Cl.
CPC ..... *B65H 3/0623* (2013.01); *B65H 9/006* (2013.01); *B65H 2301/331* (2013.01); *B65H 2402/54* (2013.01); *B65H 2403/40* (2013.01); *B65H 2403/72* (2013.01); *B65H 2403/73* (2013.01); *B65H 2403/732* (2013.01); *B65H 2403/81* (2013.01); *B65H 2403/942* (2013.01)

(58) Field of Classification Search
CPC ..... B65H 2403/92; B65H 3/0623; B65H 2403/40; B65H 2403/81; B65H 2403/942
USPC ..... 271/242
See application file for complete search history.

(56) References Cited

U.S. PATENT DOCUMENTS 6,213,458 B1 * 4/2001 Tamura ..... B65H 3/0669 271/10.11

* cited by examiner

*Primary Examiner* — Jeremy R Severson
(74) *Attorney, Agent, or Firm* — Lin & Associates Intellectual Property, Inc.

(57) ABSTRACT

A paper feeding mechanism includes a feeding path, a driving motor, a bidirectional transmission mechanism, at least one feeding roller, a unidirectional transmission mechanism and at least one blocking roller. The driving motor is controllable to output a driving force towards a forward direction or a driving force towards a reverse direction. The bidirectional transmission mechanism is connected to the driving motor. The at least one feeding roller is mounted in the feeding path. The at least one feeding roller is connected to the bidirectional transmission mechanism. The unidirectional transmission mechanism is connected to the driving motor. The at least one blocking roller is mounted in the feeding path. The at least one blocking roller is disposed to a downstream of the at least one feeding roller. The at least one blocking roller is connected to the unidirectional transmission mechanism.

11 Claims, 8 Drawing Sheets

PAPER FEEDING MECHANISM

CROSS-REFERENCE TO RELATED APPLICATION

The present application is based on, and claims priority from, China Patent Application No. 202120843868.3, filed Apr. 22, 2021, the disclosure of which is hereby incorporated by reference herein in its entirety.

BACKGROUND OF THE INVENTION

1. Field of the Invention

The present invention generally relates to a paper feeding mechanism, and more particularly to a paper feeding mechanism which uses a single driving motor for eliminating a paper skew.

2. The Related Art

Referring to FIG. 6, FIG. 7 and FIG. 8, in a paper feeding process of a conventional paper feeding mechanism, a paper skew means that a leading edge of a paper and an axis direction of a feeding roller are non-parallel. When the paper skew is occurred in the paper feeding process, it is apt to cause a paper jam, it is apt to affect quality of a scanned image or it is apt to affect quality of a printed image. Therefore, the conventional paper feeding mechanism includes a group of deskew rollers 70 to eliminate the paper skew. The conventional paper feeding mechanism further includes a feeding path and a group of pickup rollers 72. The group of the deskew rollers 70 are arranged in the feeding path, and the group of the deskew rollers 70 are located to a downstream of the group of the pickup rollers 72. The group of the deskew rollers 70 are driven by an independent first motor 71, and the group of the pickup rollers 72 are driven by an independent second motor 73, so that rotation time and rotation directions of the group of the deskew rollers 70 are fully independent with the group of the pickup rollers 72.

Referring to FIG. 7 and FIG. 8, the group of the deskew rollers 70 keep static at the time of the group of the pickup rollers 72 starting feeding the paper. Thus, when the skewed paper is fed to positions of the group of the deskew rollers 70 by the group of the pickup rollers 72, the leading edge of the paper is blocked by the group of the deskew rollers 70, and the leading edge of the paper is aligned with an axis direction of the group of the deskew rollers 70. After the paper skew is eliminated, rotations of the group of the deskew rollers 70 are restored, and the paper is transmitted downstream.

However, the independent first motor 71 is additionally increased, so a manufacturing cost of the conventional paper feeding mechanism is increased.

Therefore, it is necessary to provide an innovative paper feeding mechanism, the innovative paper feeding mechanism uses a single driving motor for eliminating a paper skew and feeding paper.

SUMMARY OF THE INVENTION

An object of the present invention is to provide a paper feeding mechanism which uses a single driving motor for eliminating a paper skew. The paper feeding mechanism includes a feeding path, a driving motor, a bidirectional transmission mechanism, at least one feeding roller, a unidirectional transmission mechanism and at least one blocking roller. The driving motor is controllable to output a driving force towards a forward direction or a driving force towards a reverse direction. The bidirectional transmission mechanism is connected to the driving motor for transmitting the driving forces. The at least one feeding roller is mounted in the feeding path. The at least one feeding roller is connected to the bidirectional transmission mechanism. The unidirectional transmission mechanism is connected to the driving motor for transmitting the driving forces. The at least one blocking roller is mounted in the feeding path. The at least one blocking roller is disposed to a downstream of the at least one feeding roller. The at least one blocking roller is connected to the unidirectional transmission mechanism. When the driving motor delivers the driving force towards the reverse direction, the bidirectional transmission mechanism transmits the driving force towards the forward direction to the at least one feeding roller, and the unidirectional transmission mechanism transmits the driving force towards the forward direction to the at least one blocking roller. When the driving motor delivers the driving force towards the forward direction, the bidirectional transmission mechanism transmits the driving force towards the forward direction to the at least one feeding roller, and the unidirectional transmission mechanism stops transmitting the driving force to the at least one blocking roller.

Another object of the present invention is to provide a paper feeding mechanism. The paper feeding mechanism includes a feeding path, a driving motor, a bidirectional transmission mechanism, at least one feeding roller, a unidirectional transmission mechanism and at least one blocking roller. The driving motor is controllable to output a driving force towards a forward direction or a driving force towards a reverse direction. The bidirectional transmission mechanism includes an input gear, two forward swing arms and a reverse swing arm. The input gear is connected with the driving motor for transmitting the driving forces. The two forward swing arms and the reverse swing arm are connected by a connecting element. The two forward swing arms and the reverse swing arm are pivotally connected with the input gear by the connecting element. The at least one feeding roller is mounted in the feeding path. The at least one feeding roller is connected to the bidirectional transmission mechanism. The unidirectional transmission mechanism is connected to the driving motor for transmitting the driving forces. The at least one blocking roller is mounted in the feeding path. The at least one blocking roller is disposed to a downstream of the at least one feeding roller. The at least one blocking roller is connected to the unidirectional transmission mechanism. When the driving motor delivers the driving force towards the reverse direction, the bidirectional transmission mechanism transmits the driving force towards the forward direction to the at least one feeding roller, and the unidirectional transmission mechanism transmits the driving force towards the forward direction to the at least one blocking roller. When the driving motor delivers the driving force towards the forward direction, the bidirectional transmission mechanism transmits the driving force towards the forward direction to the at least one feeding roller, and the unidirectional transmission mechanism stops transmitting the driving force to the at least one blocking roller.

Another object of the present invention is to provide a paper feeding mechanism. The paper feeding mechanism includes a feeding path, a driving motor, a bidirectional transmission mechanism, at least one feeding roller, a unidirectional transmission mechanism and at least one blocking roller. The driving motor is controllable to output a driving force towards a forward direction or a driving force towards a reverse direction. The bidirectional transmission mechanism includes an input gear, two forward swing arms, a reverse swing arm, a forward gear assembly, a reverse gear assembly and an output gear assembly. The input gear is connected with the driving motor for transmitting the driving forces. The two forward swing arms and the reverse swing arm are connected by a connecting element. The two forward swing arms and the reverse swing arm are pivotally connected with the input gear by the connecting element. The forward gear assembly is mounted to the two forward swing arms to make the forward gear assembly move along with the two forward swing arms. The forward gear assembly and the two forward swing arms are connected with the input gear for transmitting the driving forces. The reverse gear assembly is mounted around the reverse swing arm to make the reverse gear assembly move along with the reverse swing arm. The reverse gear assembly and the reverse swing arm are connected with the input gear for transmitting the driving forces. The output gear assembly is arranged at an intersection area among swinging paths of the two forward swing arms and a swinging path of the reverse swing arm. The at least one feeding roller is mounted in the feeding path. The at least one feeding roller is connected to the bidirectional transmission mechanism. The output gear assembly is connected to the at least one feeding roller. The unidirectional transmission mechanism is connected to the driving motor for transmitting the driving forces. The at least one blocking roller is mounted in the feeding path. The at least one blocking roller is disposed to a downstream of the at least one feeding roller. The at least one blocking roller is connected to the unidirectional transmission mechanism. When the driving motor delivers the driving force towards the reverse direction, the bidirectional transmission mechanism transmits the driving force towards the forward direction to the at least one feeding roller, and the unidirectional transmission mechanism transmits the driving force towards the forward direction to the at least one blocking roller. When the driving motor delivers the driving force towards the forward direction, the bidirectional transmission mechanism transmits the driving force towards the forward direction to the at least one feeding roller, and the unidirectional transmission mechanism stops transmitting the driving force to the at least one blocking roller.

As described above, the paper feeding mechanism uses the single driving motor for eliminating the skew of paper and feeding the paper, so a manufacturing cost of the paper feeding mechanism is decreased.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
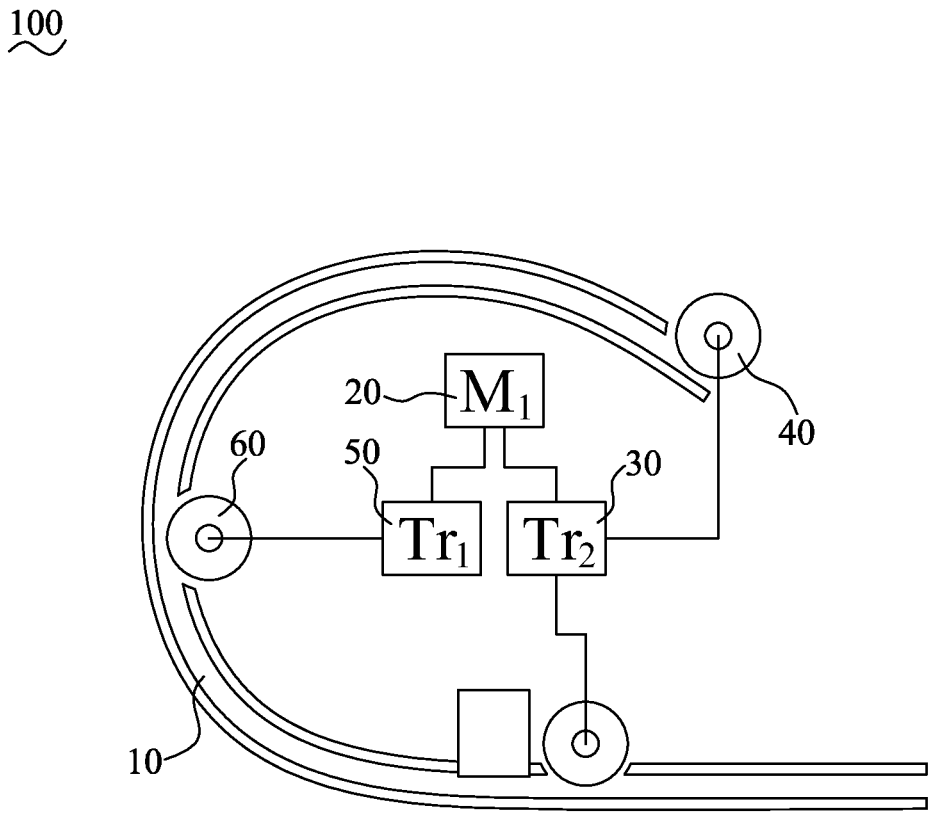
FIG. 1 is a diagrammatic drawing of a paper feeding mechanism in accordance with a preferred embodiment of the present invention.
Figure 2:
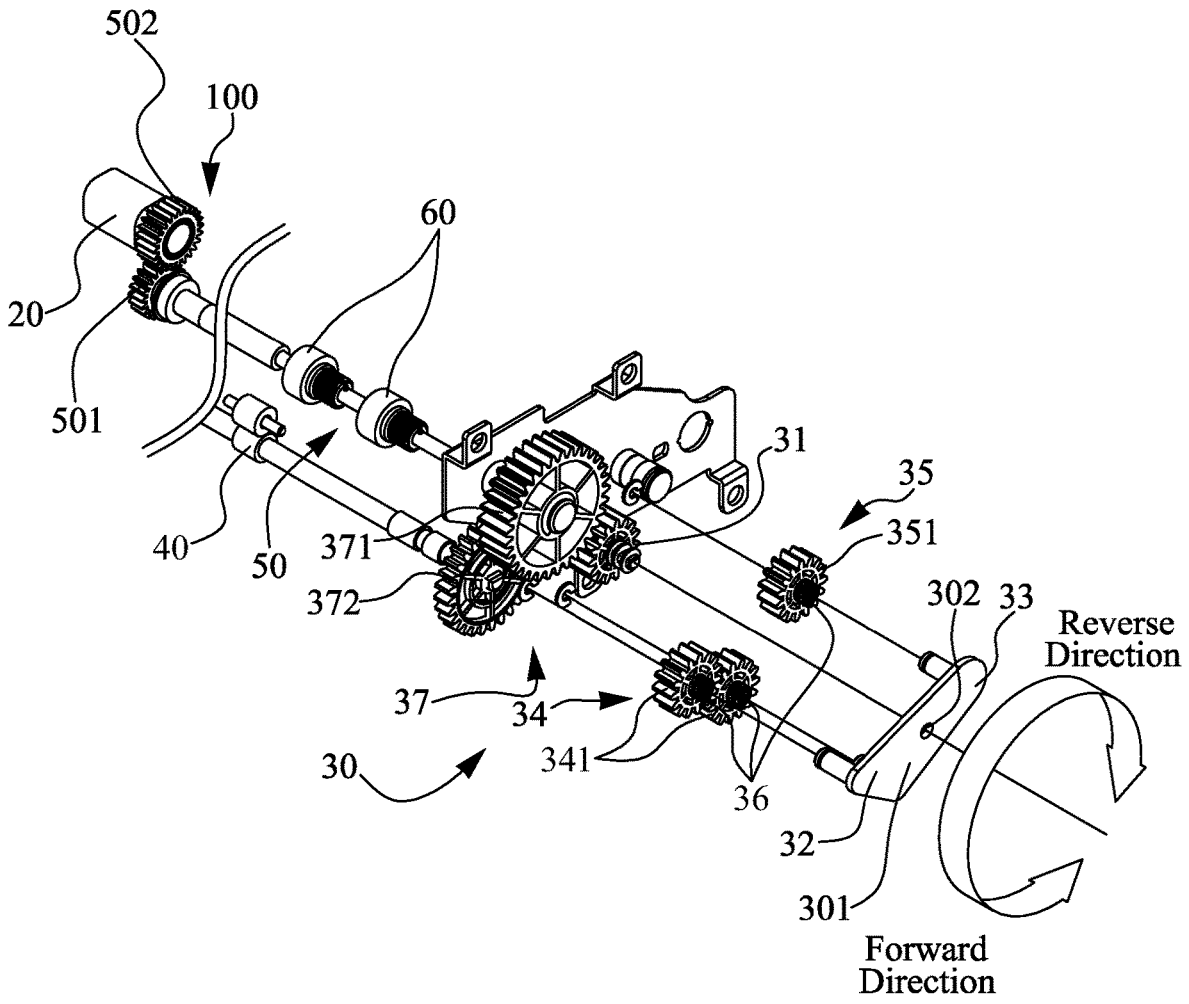
FIG. 2 is an exploded view of the paper feeding mechanism in accordance with the present invention.
Figure 3:
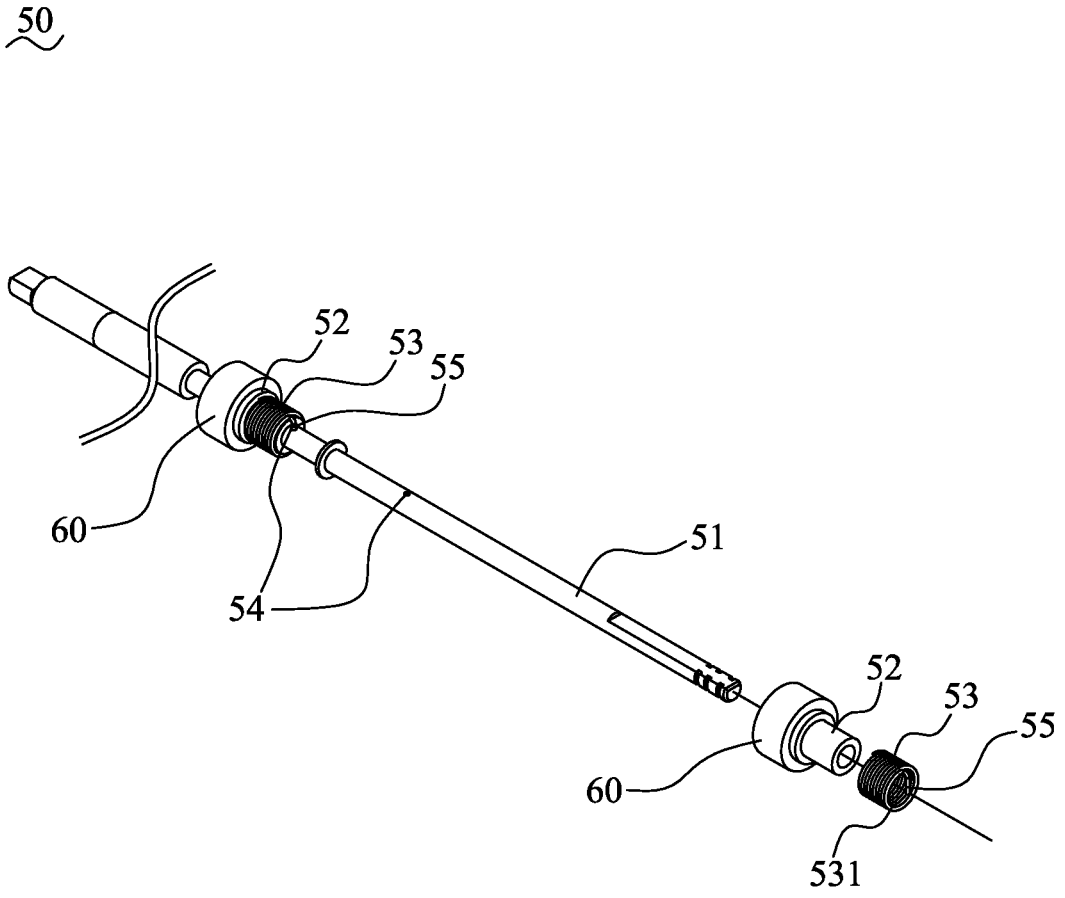
FIG. 3 is an exploded view of an unidirectional transmission mechanism of the paper feeding mechanism in accordance with the present invention.

Referring to FIG. 1 to FIG. 3, a paper feeding mechanism 100 in accordance with a preferred embodiment of the present invention is shown. The paper feeding mechanism 100 includes a feeding path 10, a driving motor 20, a bidirectional transmission mechanism 30, at least one feeding roller 40, a unidirectional transmission mechanism 50 and at least one blocking roller 60.

In fact, it is impossible to list all assembling directions of components of the paper feeding mechanism 100. The components include the driving motor 20, the bidirectional transmission mechanism 30, the at least one feeding roller 40, the unidirectional transmission mechanism 50 and the at least one blocking roller 60. Therefore, in order to describe rotation directions of the components and driving forces more accurately, when the rotation directions of the components and the driving forces are described in the detailed description, a rotation direction of the at least one feeding roller 40 is acted as a reference. A forward direction is defined as the rotation direction in which the at least one feeding roller 40 feeds paper towards a downstream of the feeding path 10, and a reverse direction is defined as the rotation direction in which the at least one feeding roller 40 feeds the paper to an upstream of the feeding path 10.

The driving motor 20 is controllable to output a driving force towards the forward direction or a driving force towards the reverse direction. The bidirectional transmission mechanism 30 is connected to the driving motor 20 for transmitting the driving forces. The at least one feeding roller 40 is mounted in the feeding path 10. The at least one feeding roller 40 is connected to the bidirectional transmission mechanism 30. The unidirectional transmission mechanism 50 is connected to the driving motor 20 for transmitting the driving forces. The at least one blocking roller 60 is mounted in the feeding path 10. The at least one blocking roller 60 is disposed to a downstream of the at least one feeding roller 40. The at least one blocking roller 60 is connected to the unidirectional transmission mechanism 50.

When the driving motor 20 delivers the driving force towards the forward direction, the bidirectional transmission mechanism 30 transmits the driving force towards the forward direction to the at least one feeding roller 40, and the unidirectional transmission mechanism 50 stops transmitting the driving force to the at least one blocking roller 60. At the moment, the paper is transmitted downstream by the at least one feeding roller 40. After a leading edge of the paper contacts with the at least one blocking roller 60, the leading edge of the paper is aligned with the at least one blocking roller 60 for eliminating a skew of the paper. When the driving motor 20 delivers the driving force towards the reverse direction, the bidirectional transmission mechanism 30 transmits the driving force towards the forward direction to the at least one feeding roller 40, and the unidirectional transmission mechanism 50 transmits the driving force towards the forward direction to the at least one blocking roller 60 for further transmitting downstream the paper of which the skew is eliminated.

Referring to FIG. 1 to FIG. 5, in order to simplify an overall structure of the paper feeding mechanism 100 in accordance with the preferred embodiment, the bidirectional transmission mechanism 30 is connect to the driving motor 20 via the unidirectional transmission mechanism 50. In the preferred embodiment, the paper feeding mechanism 100 includes two blocking rollers 60. The unidirectional transmission mechanism 50 is connected with the two blocking rollers 60. The two blocking rollers 60 are arranged symmetrically to two sides of the paper feeding mechanism 100. The unidirectional transmission mechanism 50 includes a transmission shaft 51, two roller hubs 52, two torsion springs 53, two blind holes 54, a first transmission gear 501 and a second transmission gear 502. One end of the transmission shaft 51 is equipped with the first transmission gear 501. The second transmission gear 502 is mounted on the first transmission gear 501, and the second transmission gear 502 is engaged with the first transmission gear 501. The second transmission gear 502 is connected to the driving motor 20, so the transmission shaft 51 is connected to the driving motor 20 through the second transmission gear 502 so as to transmit the driving forces.

The transmission shaft 51 defines the two blind holes 54. The two roller hubs 52 are rotatably mounted around the transmission shaft 51, and one ends of the two roller hubs 52 are connected with the two blocking rollers 60. The other ends of the two roller hubs 52 project out of the two blocking rollers 60. One end of each torsion spring 53 has a fastening end 531. The fastening end 531 of each torsion spring 53 has a hook 55. Two free ends of the two torsion springs 53 are worn around outer peripheries of the other ends of the two roller hubs 52. The two blind holes 54 are adjacent to the fastening ends 531 of the two torsion springs 53. The hooks 55 of the two torsion springs 53 are inserted into the two blind holes 54, the fastening ends 531 of the two torsion springs 53 are fastened to the transmission shaft 51, and the two torsion springs 53 are connected to the transmission shaft 51, so that the two torsion springs 53 rotate with the transmission shaft 51.

The rotate direction of each torsion spring 53 is the forward direction, so when the transmission shaft 51 rotates in the forward direction, friction forces are exerted to the two torsion springs 53 to twist the two torsion springs 53 more tightly, inner radiuses of the two torsion springs 53 are shrunk, and the two torsion springs 53 clamp the two roller hubs 52, respectively by virtue of shrinking the inner radiuses of the two torsion springs 53. Nevertheless, when the transmission shaft 51 rotates in the reverse direction, the friction forces exerted to the two torsion springs 53 to loosen the two torsion springs 53, so the torsion springs 53 disattach with the roller hubs 52 and make the two blocking rollers 60 idle.

Referring to FIG. 2 and FIG. 3, the bidirectional transmission mechanism 30 includes an input gear 31, two forward swing arms 32, a reverse swing arm 33, a forward gear assembly 34, a reverse gear assembly 35, a compression spring 36 and an output gear assembly 37. The input gear 31 is connected with the driving motor 20 via the transmission shaft 51. The input gear 31 is connected with the driving motor 20 for transmitting the driving forces. The two forward swing arms 32 and the reverse swing arm 33 are integrally formed in one piece. The two forward swing arms 32 and the reverse swing arm 33 are connected by a connecting element 301. A middle of the connecting element 301 has a pivoting hole 302. The input gear 31 is pivoted to the pivoting hole 302. The two forward swing arms 32 and the reverse swing arm 33 are pivotally connected with the input gear 31 by the connecting element 301. The input gear 31 functions as a pivotal axis of the two forward swing arms 32, the reverse swing arm 33 and the connecting element 301. The forward gear assembly 34 is mounted to the two forward swing arms 32 to make the forward gear assembly 34 move along with the two forward swing arms 32. The forward gear assembly 34 and the two forward swing arms 32 are connected with the input gear 31 for transmitting the driving forces. The reverse gear assembly 35 is mounted around the reverse swing arm 33 to make the reverse gear assembly 35 move along with the reverse swing arm 33. The reverse gear assembly 35 and the reverse swing arm 33 are connected with the input gear 31 for transmitting the driving forces. The output gear assembly 37 is arranged at an intersection area among swinging paths of the two forward swing arms 32 and a swinging path of the reverse swing arm 33. The output gear assembly 37 is connected to the at least one feeding roller 40.

Figure 4:
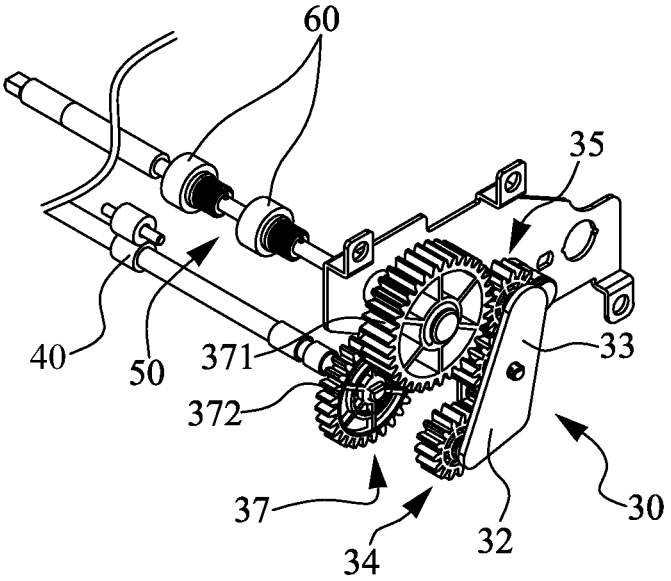
FIG. 4 is a schematic diagram that shows an operation status of the paper feeding mechanism, wherein a driving motor outputs a driving force towards a reverse direction.
Figure 5:
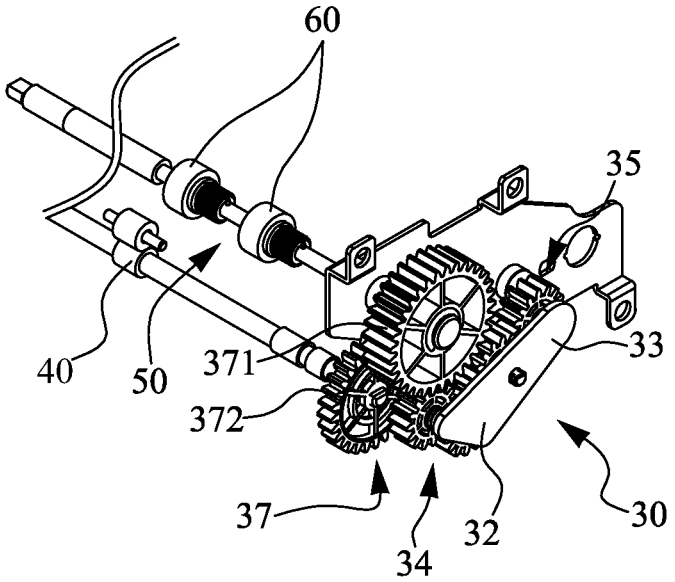
FIG. 5 is another schematic diagram that shows another operation status of the paper feeding mechanism, wherein the driving motor outputs a driving force towards a forward direction.
Figure 6:
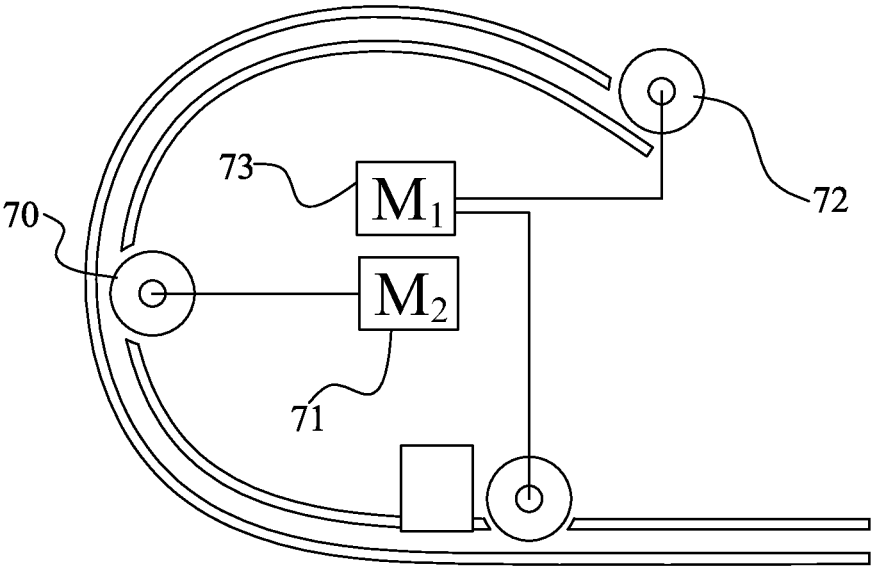
FIG. 6 (Prior Art)
FIG. 6 is a diagrammatic drawing of a conventional paper feeding mechanism in prior art.
Figure 7:
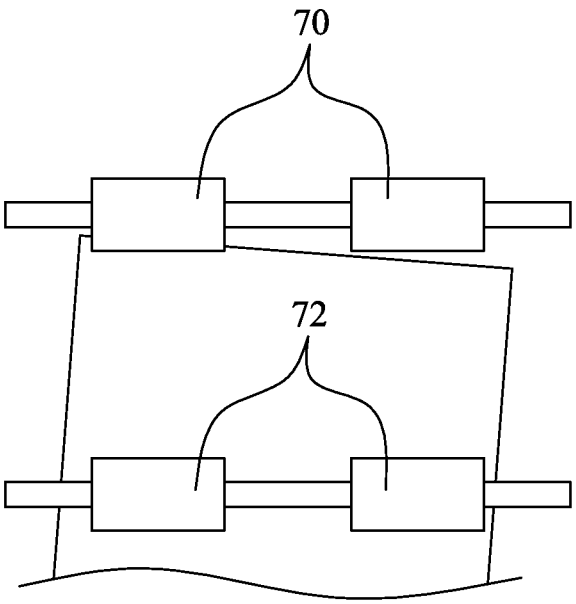
FIG. 7 (Prior Art)
FIG. 7 is a diagrammatic drawing of the conventional paper feeding mechanism of FIG. 6, wherein paper is skewed.
Figure 8:
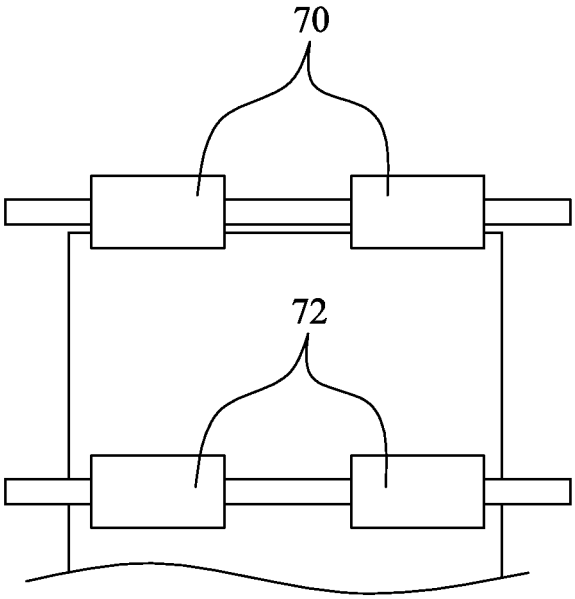
FIG. 8 (Prior Art)
FIG. 8 is another diagrammatic drawing of the conventional paper feeding mechanism of FIG. 6, wherein a skew of the paper is eliminated.

Referring to FIG. 2, FIG. 4, and FIG. 5, in this preferred embodiment, the output gear assembly 37 includes a relay gear 371 and an output gear 372. The relay gear 371 is arranged at the intersection area among the swinging paths of the two forward swing arms 32 and the swinging path of the reverse swing arm 33. The output gear 372 is engaged with the relay gear 371. The output gear 372 is connected to the at least one feeding roller 40.

When the forward gear assembly 34 transmits the driving force, the driving force is towards the reverse direction, the driving motor 20 transmits the driving force towards the reverse direction, at the moment, the two forward swing arms 32 swing towards the output gear 372, so that the driving force is transmitted to the output gear 372 via the forward gear assembly 34. When the reverse gear assembly 35 transmits the driving force, a direction of the driving force is unchanged, the driving motor 20 transmits the driving force towards the forward direction, at the moment, the reverse swing arm 33 swings towards the output gear 372, so that the driving force is transmitted to the output gear 372 via the reverse gear assembly 35.

The reverse gear assembly 35 includes a reverse gear 351 and a compression spring 36. The compression spring 36 is mounted between the reverse gear 351 and the reverse swing arm 33, so that the driving force is towards the reverse direction at the time of the driving force being delivered by the reverse gear assembly 35. The compression spring 36 exerts a blocking force to the reverse gear 351. When the driving motor 20 outputs the driving force towards the reverse direction, the reverse gear 351 is driven by the input gear 31, and the reverse gear 351 pivots to the input gear 31 to rotate towards the reverse direction, and then the reverse swing arm 33 swings towards the relay gear 371. The reverse gear assembly 35 rotates towards the reverse direction to transmit the driving force towards the reverse direction to the relay gear 371, and then the relay gear 371 rotates towards the reverse direction to transmit the driving force towards the reverse direction to the output gear 372 so as to drive the output gear 372 to rotate towards the forward direction.

The forward gear assembly 34 includes two forward gears 341 and another two compression springs 36. The two forward gears 341 are meshed with each other. The two compression springs 36 are mounted between the two forward gears 341 and the two forward swing arms 32, respectively, so that the direction of the driving force is unchanged at the time of the driving force being delivered by the forward gear assembly 34. The two compression springs 36 exert the blocking force to the two forward gears 341. When the driving motor 20 outputs the driving force towards the forward direction, the two forward gears 341 are driven by the input gear 31, and the two forward gears 341 rotate around the input gear 31 and rotate towards the forward direction, so that the two forward swing arms 32 swing towards the relay gear 371. The forward gear assembly 34 directly transmits the driving force towards the forward direction to the relay gear 371, and then the relay gear 371 rotates towards the reverse direction to transmit the driving force towards the forward direction to the output gear 372, so that the output gear 372 rotates towards the forward direction.

The reverse gear assembly 35 includes an odd number of the intermeshed reverse gears 351 and an odd number of the compression springs 36. The bidirectional transmission mechanism 30 includes an odd number of the reverse swing arms 33. The odd number of the compression springs 36 are assembled between the odd number of the reverse gears 351 and the odd number of the reverse swing arms 33.

The forward gear assembly 34 includes an even number of the intermeshed forward gears 341 and an even number of the compression springs 36. The bidirectional transmission mechanism 30 includes an even number of the forward swing arms 32, the even number of the compression springs 36 are assembled between the odd number of the forward gears 341 and the odd number of the forward swing arms 32.

As described above, the paper feeding mechanism 100 uses the single driving motor 20 for eliminating the skew of the paper and feeding the paper, so a manufacturing cost of the paper feeding mechanism 100 is decreased.

What is claimed is:

1. A paper feeding mechanism, comprising:

a feeding path;

a driving motor controllable to output a driving force towards a forward direction or a driving force towards a reverse direction;

a bidirectional transmission mechanism connected to the driving motor for transmitting the driving forces;

at least one feeding roller mounted in the feeding path, the at least one feeding roller being connected to the bidirectional transmission mechanism;

a unidirectional transmission mechanism connected to the driving motor for transmitting the driving forces; and at least one blocking roller mounted in the feeding path, the at least one blocking roller being disposed to a downstream of the at least one feeding roller, the at least one blocking roller being connected to the unidirectional transmission mechanism, wherein when the driving motor delivers the driving force towards the reverse direction, the bidirectional transmission mechanism transmits the driving force towards the forward direction to the at least one feeding roller, and the unidirectional transmission mechanism transmits the driving force towards the forward direction to the at least one blocking roller, and wherein when the driving motor delivers the driving force towards the forward direction, the bidirectional transmission mechanism transmits the driving force towards the forward direction to the at least one feeding roller, and the unidirectional transmission mechanism stops transmitting the driving force to the at least one blocking roller.

2. The paper feeding mechanism as claimed in claim 1, wherein the unidirectional transmission mechanism includes a transmission shaft, two roller hubs and two torsion springs, the transmission shaft is connected with the driving motor so as to transmit the driving forces, the two roller hubs are rotatably mounted around the transmission shaft, and one ends of the two roller hubs are connected with the two blocking rollers, the other ends of the two roller hubs project out of the two blocking rollers, one end of each torsion spring has a fastening end, the fastening ends of the two torsion springs are fastened to the transmission shaft, and the two torsion springs are connected to the transmission shaft, two free ends of the two torsion springs are worn around outer peripheries of the other ends of the two roller hubs, a rotate direction of each torsion spring is the forward direction, so when the transmission shaft rotates in the forward direction, friction forces are exerted to the two torsion springs to twist the two torsion springs more tightly, inner radiuses of the two torsion springs are shrunk.

3. The paper feeding mechanism as claimed in claim 2, wherein the transmission shaft defines two blind holes, the fastening end of each torsion spring has a hook, the hooks of the two torsion springs are inserted into the two blind holes, so that the two torsion springs rotate with the transmission shaft.

4. The paper feeding mechanism as claimed in claim 1, wherein the bidirectional transmission mechanism includes an input gear, two forward swing arms and a reverse swing arm, the input gear is connected with the driving motor for transmitting the driving forces, the two forward swing arms and the reverse swing arm are connected by a connecting element, the two forward swing arms and the reverse swing arm are pivotally connected with the input gear by the connecting element, the input gear functions as a pivotal axis of the two forward swing arms, the reverse swing arm and the connecting element.

5. The paper feeding mechanism as claimed in claim 4, wherein the two forward swing arms and the reverse swing arm are integrally formed in one piece.

6. The paper feeding mechanism as claimed in claim 4, wherein the bidirectional transmission mechanism includes a forward gear assembly, a reverse gear assembly and an output gear assembly, the forward gear assembly is mounted to the two forward swing arms to make the forward gear assembly move along with the two forward swing arms, the forward gear assembly and the two forward swing arms are connected with the input gear for transmitting the driving forces, the reverse gear assembly is mounted around the reverse swing arm to make the reverse gear assembly move along with the reverse swing arm, the reverse gear assembly and the reverse swing arm are connected with the input gear for transmitting the driving forces, the output gear assembly is arranged at an intersection area among swinging paths of the two forward swing arms and a swinging path of the reverse swing arm, the output gear assembly is connected to the at least one feeding roller, the output gear assembly includes an output gear, when the forward gear assembly transmits the driving force, the driving force is towards the reverse direction, the driving motor transmits the driving force towards the reverse direction, at the moment, the two forward swing arms swing towards the output gear, so that the driving force is transmitted to the output gear via the forward gear assembly, when the reverse gear assembly transmits the driving force, a direction of the driving force is unchanged, the driving motor transmits the driving force towards the forward direction, at the moment, the reverse swing arm swings towards the output gear, so that the driving force is transmitted to the output gear via the reverse gear assembly.

7. The paper feeding mechanism as claimed in claim 6, wherein the output gear assembly includes a relay gear, the relay gear is arranged at the intersection area among the swinging paths of the two forward swing arms and the swinging path of the reverse swing arm, the output gear is engaged with the relay gear, the output gear is connected to the at least one feeding roller.

8. The paper feeding mechanism as claimed in claim 6, wherein the reverse gear assembly includes an odd number of intermeshed reverse gears and an odd number of compression springs, the bidirectional transmission mechanism includes an odd number of the reverse swing arms, the odd number of the compression springs are assembled between the odd number of the reverse gears and the odd number of the reverse swing arms.

9. The paper feeding mechanism as claimed in claim 6, wherein the forward gear assembly includes an even number of intermeshed forward gears and an even number of compression springs, the bidirectional transmission mechanism includes an even number of forward swing arms, the even number of the compression springs are assembled between the odd number of the forward gears and the odd number of the forward swing arms.

10. A paper feeding mechanism, comprising:

a feeding path;

a driving motor controllable to output a driving force towards a forward direction or a driving force towards a reverse direction;

a bidirectional transmission mechanism including an input gear, two forward swing arms and a reverse swing arm, the input gear being connected with the driving motor for transmitting the driving forces, the two forward swing arms and the reverse swing arm being connected by a connecting element, the two forward swing arms and the reverse swing arm being pivotally connected with the input gear by the connecting element;

at least one feeding roller mounted in the feeding path, the at least one feeding roller being connected to the bidirectional transmission mechanism;

a unidirectional transmission mechanism connected to the driving motor for transmitting the driving forces; and at least one blocking roller mounted in the feeding path, the at least one blocking roller being disposed to a downstream of the at least one feeding roller, the at least one blocking roller being connected to the unidirectional transmission mechanism, wherein when the driving motor delivers the driving force towards the reverse direction, the bidirectional transmission mechanism transmits the driving force towards the forward direction to the at least one feeding roller, and the unidirectional transmission mechanism transmits the driving force towards the forward direction to the at least one blocking roller, and wherein when the driving motor delivers the driving force towards the forward direction, the bidirectional transmission mechanism transmits the driving force towards the forward direction to the at least one feeding roller, and the unidirectional transmission mechanism stops transmitting the driving force to the at least one blocking roller.

11. A paper feeding mechanism, comprising:

a feeding path;

a driving motor controllable to output a driving force towards a forward direction or a driving force towards a reverse direction;

a bidirectional transmission mechanism including an input gear, two forward swing arms, a reverse swing arm, a forward gear assembly, a reverse gear assembly and an output gear assembly, the input gear being connected with the driving motor for transmitting the driving forces, the two forward swing arms and the reverse swing arm being connected by a connecting element, the two forward swing arms and the reverse swing arm being pivotally connected with the input gear by the connecting element, the forward gear assembly being mounted to the two forward swing arms to make the forward gear assembly move along with the two forward swing arms, the forward gear assembly and the two forward swing arms being connected with the input gear for transmitting the driving forces, the reverse gear assembly being mounted around the reverse swing arm to make the reverse gear assembly move along with the reverse swing arm, the reverse gear assembly and the reverse swing arm being connected with the input gear for transmitting the driving forces, the output gear assembly being arranged at an intersection area among swinging paths of the two forward swing arms and a swinging path of the reverse swing arm;

at least one feeding roller mounted in the feeding path, the at least one feeding roller being connected to the bidirectional transmission mechanism, the output gear assembly being connected to the at least one feeding roller;

a unidirectional transmission mechanism connected to the driving motor for transmitting the driving forces; and at least one blocking roller mounted in the feeding path, the at least one blocking roller being disposed to a downstream of the at least one feeding roller, the at least one blocking roller being connected to the unidirectional transmission mechanism, wherein when the driving motor delivers the driving force towards the reverse direction, the bidirectional transmission mechanism transmits the driving force towards the forward direction to the at least one feeding roller, and the unidirectional transmission mechanism transmits the driving force towards the forward direction to the at least one blocking roller, and wherein when the driving motor delivers the driving force towards the forward direction, the bidirectional transmission mechanism transmits the driving force towards the forward direction to the at least one feeding roller, and the unidirectional transmission mechanism stops transmitting the driving force to the at least one blocking roller.

* * * * *